United States Patent [19]

Paganini et al.

[11] 4,398,257

[45] Aug. 9, 1983

[54] CUSTOMER QUEUE CONTROL METHOD AND SYSTEM

[75] Inventors: Bruno J. Paganini, Centerville, Ohio; Yodhin Anavil, Cerritos, Calif.; William J. Hale; Kwang H. Lee, both of Dayton, Ohio

[73] Assignee: NCR Corporation, Dayton, Ohio

[21] Appl. No.: 239,098

[22] Filed: Feb. 27, 1981

[51] Int. Cl.[3] ..... G08B 7/00

[52] U.S. Cl. ..... 364/550; 179/15 A; 340/286 R; 377/6; 377/27; 364/478; 364/900

[58] Field of Search ..... 364/200, 900, 710, 436, 364/478, 550; 340/286, 332, 692; 179/15 A; 235/92 TC; 377/6, 27

[56] References Cited

U.S. PATENT DOCUMENTS

| | | | |
|---|---|---|---|
| 3,304,416 | 2/1967 | Wolf | 340/286 |
| 3,582,949 | 6/1971 | Forst | 340/692 |
| 3,803,578 | 4/1974 | LaVanway | 340/286 R |
| 3,868,670 | 2/1975 | O'Nory et al. | 340/286 |
| 3,870,818 | 3/1975 | Barton et al. | 340/692 |
| 3,893,094 | 7/1975 | Thorson et al. | 340/258 B |
| 3,893,097 | 7/1975 | Lach et al. | 340/286 |
| 3,921,160 | 11/1975 | Ratner | 340/286 |
| 3,998,045 | 12/1976 | Lester | 364/710 |
| 4,276,444 | 6/1981 | Tanimoto et al. | 364/710 |

OTHER PUBLICATIONS

Bank Systems & Equipment; Sep. 1979, "Customer Waiting Time Cut 10–50% with Lobby Traffic Control Gear", by J. Fioravante.

Gorney, L.; "Queuing Theory, The Science of Wait Control"–Part I–Queue Representation (Apr. 1979) and Part II: System Types (May 1979); Byte Publications, Inc.

Bank Systems & Equipment, Jan. 1979; Advertisement Re "Electrotec, Inc. New Microprocessor Lobby Control System"–p. 90.

Bank Systems & Equipment, Jan. 1979, Advertisement Re "Custom Alert Teller Traffic Direction System", pp. 120.

*Primary Examiner*—Errol A. Krass

*Attorney, Agent, or Firm*—J. T. Cavender; Albert L. Sessler, Jr.

[57] ABSTRACT

A customer queue control system for an establishment having a plurality of customer service stations utilizes a main queue and a plurality of local queues, and includes a detector to detect the presence of a customer at the head of the main queue, keys at each service station to signify the status of that station, a voice message device to direct a customer at the head of the main queue to a local queue selected to provide the probable minimum waiting time, and a data processing system for controlling the voice message device in accordance with the presence of a customer in the main queue, the number of customers in each local queue, the status of each local queue, and the probable service delay time per customer in each local queue.

17 Claims, 11 Drawing Figures j = 1
198
264
196
DAT j = Ø OR 3 ?
200
YES
NO
DAT j = 2 ?
202
YES
NO
222
NATT(P) = j ? FOR P = 1, OR 2, OR P-1
204
YES
NO
DAT(j) = Ø
205
CDT(j) < Ø ?
207
NO
YES
CDT(j) = CDT(j) - t
228
CDT(j) ≤ Ø ?
230
NO
YES
PTAT(j) = Ø ?
209
YES
NO
232
CDT(j) = -1
239
236
PTAT(j) = 2 ?
234
YES
NO
206
DISABLE INTERRUPT
238
DISABLE INTERRUPT
NATT(P+1) = NATT(P) FOR P = 1..P NATT(1) = j
208
240
NATT(P) = j
210
P = P + 1 ; NATT(P) = Ø
212
DAT(j) = Ø ; CDT(j) = DPDT(j)
ENABLE INTERRUPT
214
220
J = J + 1
216
j = N ?
NO
YES
218
224

TRFFLG = 1 ?
NO
YES
362
360
BUSY = 0
396
BUSY = 1
364
GATECK = 0
394
TRFFLG = 0
366
368
M2(z) = M2(c)
370
M2(b) = 0 ?
372
NO
YES
376
374
M2(z+1) = M2(f)
M2(z+1) = M2(e)
M2(z+2) = M2(d)
378
M2(z+3) = M2[f+M2(a)]
380
M2(z+4) = 00
382
P3 = z ; GATECK = 1
384
392
P4 = M2(P3)
386
420
P3 = P3 + 1
388
390
P4 = 00 ?
YES
NO
398

CUSTOMER QUEUE CONTROL METHOD AND SYSTEM

BACKGROUND OF THE INVENTION

In certain types of business establishments, such as banks, having a number of customer service stations, all available to customers and performing essentially the same service functions, problems of excessive customer waiting time and lobby congestion are common.

Servicing of a large number of customers with this type of arrangement inevitably involves the use of lines or "queues". For purposes of the present description, a queue may be defined as a waiting line controlled by some service mechanism. An item is an element of the queue. An item enters the queue at the "tail" of the queue. The item waits in line until it arrives at the "head" of the queue. The item is then serviced at the first available "service facility" and leaves the queue at the time of movement to said service facility. The reference to the "head" and "tail" of a queue implies that items entering or leaving must follow a definite ordering scheme as members of a queue. This is the dispatching discipline of the queue. A queue can have only two operations performed upon items: the insertion of an item into the queue at the tail of the queue, and the deletion of an item at the head of the queue. In the present description, the single-queue multiple-server type of queue employs a first-in, first-out dispatching discipline.

Switching from queues at each serving station to one single line for all customers is one step that can cut down on lobby congestion, offer more customer privacy, and equalize waiting time. However, rope and post mazes create new problems. They tend to decrease the speed at which traffic moves. Experiments show that the customer at the front of the line often needs prompting in locating a free server.

As indicated above, the objectives sought to be obtained by use of a single-line multiple-server queue are fairness, privacy and increased service to all customers. However the operator's productivity depends upon three factors, including the operator's free time between transactions; the attentiveness of the customer at the head of the queue; and the distance between the head of the queue and the service facility (travel time). Several types of single line lobby traffic control methods are currently being used.

The first of these methods may be described as a human directed method. This is probably the method used most extensively in commercial banks, savings associations, airport ticket offices, and so on. A free operator watches the waiting line for customers and manually, or by voice, signals the head of the queue to proceed to the open station. In larger installations, security guards and floor walkers may be employed to direct the customer at the head of the queue to available stations.

A second type of control of lobby traffic is an electronic traffic control system, and several "customer alert indicators" are available for use in such a system. In one type of system, a teller-activated device is employed, with tellers or service station operators pressing keys to indicate that they are free for the next customer. A glass panel then displays an arrow showing the customers at the head of the waiting line the direction in which to move to find the available teller. The display is usually placed midway between service station in front of the queue. Panels display "wait for next available teller" messages if no key is depressed by the service station operator. Refinements of this system may include a chime to catch the attention of the customer at the head of the queue, operator numbers in indicators, and lights placed adjacent to operator stations which can be illuminated to indicate the availability of that station.

Another type of system employs a customer-activated unit. These indicators are not dependent upon buttons operated by service station operators. Instead, devices are activated by customers stepping away from operator stations. Systems employing either wires or wireless systems may be utilized. Wireless systems use shortwave transmitters and receivers instead of being wired between signal means and the front panel. Mats at the head of the line and/or at each teller station are used to detect the presence of customers. Other types of systems may employ light-sensitive or radio wave devices for customer detection.

Systems such as those described above have been found to present certain problems which interfere with optimum operation. Banks and other users of these systems find that customers at the front of the waiting line often need prompting to help find a free service station operator. Bandit barriers in banks often obstruct sound and produce glare, compounding a customer's difficulties in recognizing teller numbers and/or arrows displayed on glass panels of present electronic systems or in finding a free teller in human directed methods.

Arrows and numbers displayed on illuminated glass panels and a variety of flashing beacons located throughout the lobby of an establishment such as a bank often do not blend with the decor of the interior.

Furthermore, most of these systems are under the control of the operator of a service station and these operators may hold back on calling for new customers in order to finish their own work, thereby slowing lobby traffic. Expensive systems, activated by more sophisticated devices, address this problem by incorporating customer presence at each service station. This added complexity, however, creates logistical problems.

SUMMARY OF THE INVENTION

The present invention is directed to a queue traffic control method which gives positive guidance as to where a customer may proceed for service, and distributes the workload for optimum server efficiency. One unique feature of the system of the present invention is its ability to direct a customer to the next available service station operator by means of a synthesized human voice. It is thus not necessary for the waiting customer to continuously direct his or her attention to the line of servers for an opening. Voice messages thus replace lighted directing devices and flashing beacons, providing orderly and efficient control of customer traffic. In replacing human directed systems, a central voice device located adjacent to the head of the single queue eliminates the need for service station operators calling out to customers, and permits full utilization of stations which may be less visible from the head of the queue, thereby allowing service stations operators to concentrate on transactions rather than upon traffic control. In addition, interior establishment decor is preserved.

The system of the present invention also presents a second fundamental innovation over present systems, in employing two different types of queues. A first such type of queue is the main queue, which is a single queue for all customers arriving at the business establishment. The second type of queue in the present invention is a local queue, one of which is provided for each service station. Local queues are the result of dispatching the head of the main queue to a service station before the server finishes servicing the present customer. These local queues are limited in length, in the illustrating embodiment of the invention, to a maximum of two customers per service station operator. On the average, and for peak load periods, the next customer arrives at a station the instant the present customer completes his or her transaction. It will be noted that in present systems, the station operator controls the pace at which customers are directed to the station, while in the proposed system the system dictates the pace at which customers must be served, by replenishing the local queues before transactions are completed.

In accordance with one embodiment of the invention, a customer queue control system for an establishment having a plurality of customer service stations and utilizing a main queue and a plurality of local queues, one for each customer service station, comprises first means to detect the presence of a customer at the head of the main queue; second means at each customer service station to signify whether each station is in an open or closed status; counting means to maintain a count of the number of customers in each local queue; timing means to provide a timed period unique for each customer service station; and customer direction means controlled by the first means, the second means, the counting means and the timing means to direct a customer at the head of the main queue to a local queue associated with one of the customer service stations in accordance with a determination as to which local queue is expected to provide the shortest waiting time for said customer.

In accordance with a second embodiment of the invention, a method for customer queue control in an establishment having multiple customer service stations includes the steps of providing a main customer queue; providing a plurality of local customer queues, each associated with a customer service station; detecting whether each station is in an open and closed status; detecting whether a customer is present at the head of the main customer queue; establishing a delay period for each station related to the median customer service time at that station; utilizing the information provided by the two detecting steps and the establishing step above to determine which local queue is likely to provide the minimum customer waiting period; and directing the customer at the head of the main queue to the selected local queue.

It is accordingly an object of the present invention to provide a customer queue control system in which dispatch of customers to individual service stations is accomplished in a manner which minimizes waiting time.

Another object is to provide a customer queue control system in which voice messages are generated to direct customers to stations from a main queue.

Another object is to provide a customer queue control system in which a main queue and a plurality of local queues are employed.

Another object is to provide a customer queue control system in which customers are directed from a main queue to a selected one of a plurality of local queues in accordance with a determination of shortest expected waiting time.

Yet another object is to provide a customer queue control system in which a plurality of local queues are utilized in combination with a main queue, and in which means are provided for generating a voice message to direct a customer at the head of the main queue to a selected one of the local queues.

With these and other objects, which will become apparent from the following description, in view, the invention includes certain novel features of construction, combinations of parts, and method steps, one form or embodiment of which is hereinafter described with reference to the drawings which accompany and form a part of this specification.

DETAILED DESCRIPTION

Figure 1:
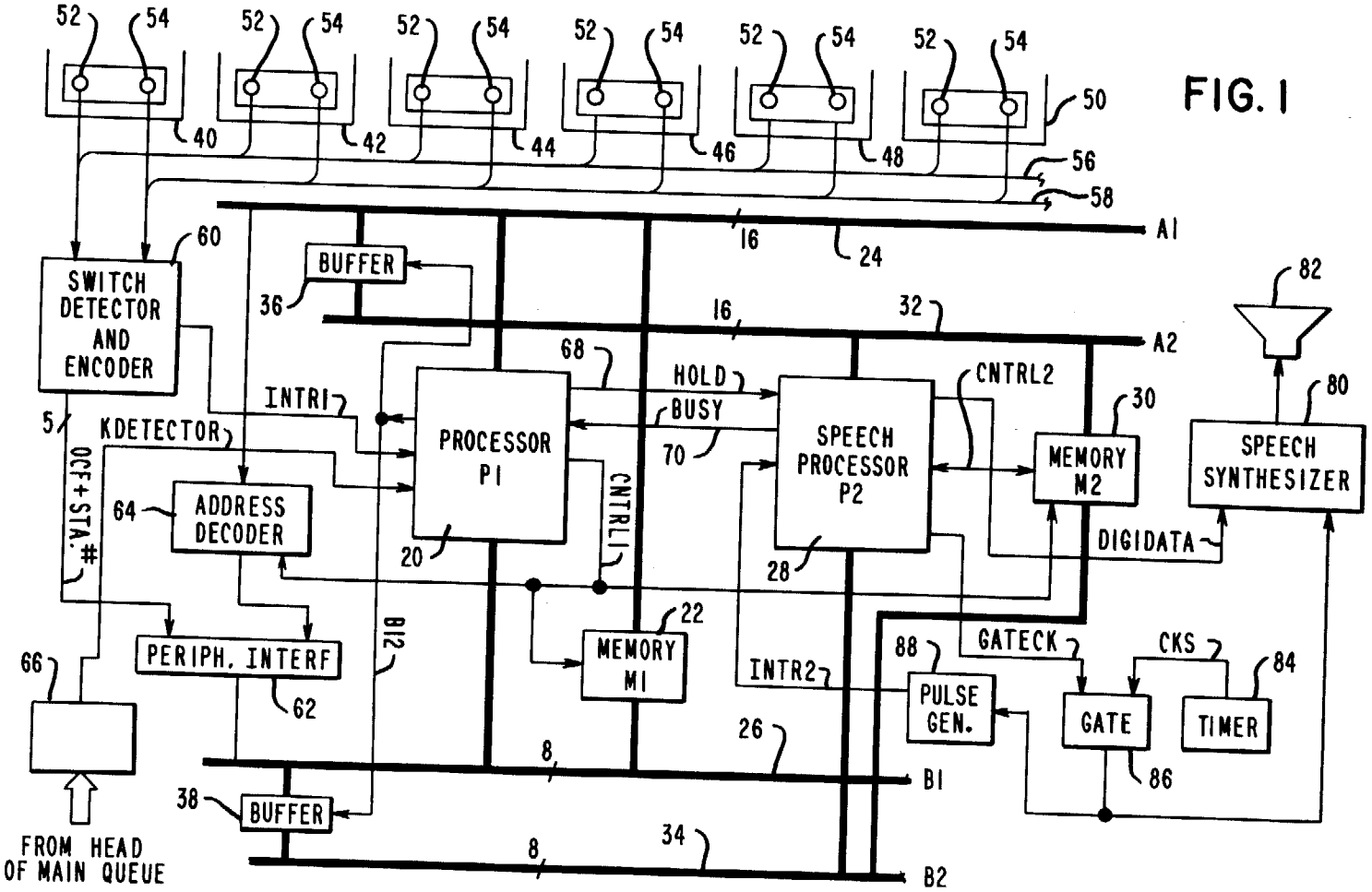
FIG. 1 is a block diagram of the customer queue control system of the present invention.

Referring now to FIG. 1, there is shown a block diagram of the system. A main processor 20 has associated therewith a memory 22, and is coupled to, and controls, address bus 24 and data bus 26, for communication with other elements of the system. A signal CNTRL1 controls communications between the processor 20, the memories 22 and 30, and address decoder 64. A speech processor 28 has associated therewith a memory 30 and is coupled to, and controls, address bus 32 and data bus 34 for communication with the other elements of the system. The busses 32 and 34 at given times are controlled by processor 20 for the purpose of transferring data to the speech processor memory 30. A signal CNTRL2 controls communication between the speech processor 28 and the associated memory 30. Buffer 36 interconnects the tri-state buses 24 and 32, while buffer 38 interconnects the tri-state buses 26 and 34. Both buffers 36 and 38 are controlled by a signal B12 which is generated by the main processor 20.

In the illustrated embodiment, the system includes a plurality of customer service stations 40, 42, 44, 46, 48 and 50. It will be recognized that a larger or smaller number of stations could be provided, if desired. Each station is provided with two control elements or keys 52 and 54. The "open" key 52 of each station may be depressed or otherwise operated to indicate that the station is open for business, or that a transaction has just been completed, and the station is ready to receive another customer. The "close" key 54 of each station may be depressed or otherwise operated to indicate that the station is closed, and is therefore not available to receive customers.

Conductors 56 and 58, connected to keys 52 and 54, respectively, of the various stations 40 to 50, provide inputs to a switch detector and encoder 60. In response to the various inputs from the service stations 40 to 50, the switch detector and encoder 60 provides a first output interrupt signal INTR1, which is applied to the main processor 20, and which indicates by its logic level whether or not either one of the two "open" or "close" keys 52 and 54 of one of the various stations 40 to 50 has been depressed. The switch detector and encoder 60 also provides five parallel output conductors to a peripheral interface 62. Four of these conductors are combined to give the identifying number of the specific station 40 to 50 in which a key has been actuated, and the fifth conductor indicates by its logic level whether the actuated key was an "open" key 52 or a "close" key 54.

The peripheral interface 62 transfers the above data to the bus 26 in response to a signal from an address decoder 64, which in turn is controlled by the main processor 20 through the bus 24. The station number and key status information output from the interface 62 is carried by the bus 26 to the main processor 20.

A signal KDETECTOR is generated by a customer presence detector 66 and is transmitted to the main processor 20 whenever a customer is present at the head of the main queue. Any suitable means, such as a switch contained in a mat upon which the customer stands, may be employed as the detector 66.

Main processor 20 controls speech processor 28 by means of a HOLD signal on line 68, which, when at a high logic level, causes the buses 32, 34 to "float" and maintains the speech processor 28 inactive. When the speech processor 28 has commenced a speech synthesizing operation, it transmits a BUSY signal back to the processor 20 on line 70 to indicate its activity. The main processor 20 provides general control of the system through its software. Voice message information is transmitted from the main processor 20 through buses 24, 26, buffers 36, 38, and buses 32, 34 to the speech processor 28. The memory 22 associated with the main processor 20 contains all definition tables and working tables, as well as pointers P, P3 and P4, and the main and interrupt programs, as will subsequently be described in greater detail. The memory 22 interfaces with the processor 20 to provide control programs and certain information required for generation of the messages transmitted to the speech processor 28.

The speech processor 28 is usually in a "hold" state until activated by the main processor 20, and controls the flow of data to a speech synthesizer 80, which in turn operates a speaker 82 to produce the speech messages heard by customers in the main queue. The processor 28 interfaces with the speech memory 30, which contains addresses of the speech data, as well as the speech data itself, plus speech processor program, as will subsequently be described in greater detail.

A timer unit 84 generates a clock pulse CKS required for use by the speech synthesizer 80. The signal CKS is transmitted to a gate 86 where it is logically combined with the signal GATECK generated by the speech processor 28. The signal GATECK is active during the time of a message transmission, and at other times will block the signal CKS from reaching the speech synthesizer 80. The gated signal CKS is also conducted to a pulse generator 88, where it is shaped to produce an interrupt signal INTR2, which is applied to the speech processor 28.

A signal DIGIDATA from the speech processor 28 carries a serial bit stream of speech data to the speech synthesizer 80 at a rate determined by the signal INTR2. This data stream, when applied to the speech synthesizer 80, causes an output to the speaker 82 which produces the desired speech message.

Specific circuit implementation in accordance with the system diagram of FIG. 1 may readily be accomplished by one having ordinary skill in the art. Suitable devices for various elements of the system are not limited to, but may include, the following. For the switch detector and encoder 60, an AM9318 priority encoder manufactured by Advanced Micro Devices, Inc., may be employed. Each such device is capable of handling up to four stations in the present system, so that if a larger number of stations are to be included, the devices may be connected in parallel. For the peripheral interface 62, an Intel 8255A programmable peripheral interface may be employed. For the address decoder 64, a Signetics 54/74138 three-to-eight line decoder/demultiplier may be employed. For the buffers 36, 38, a Fairchild 74S241 device may be employed. The processors 20 and 28 may be implemented using an Intel 8085 microprocessor. For the memories 22, 30, an Intel 2716 read-only memory and an Intel 8185 read/write memory may be employed. For the speech synthesizer 80, a suitable device is a Motorola MC3417 continuously variable slope delta modulator. The timer 84 and the gate 86 may be implemented together in a single Intel 8253 programmable interface timer (mode 3). For the pulse generator 88, a Fairchild 9600 monostable multivibrator may be used.

Figure 2:
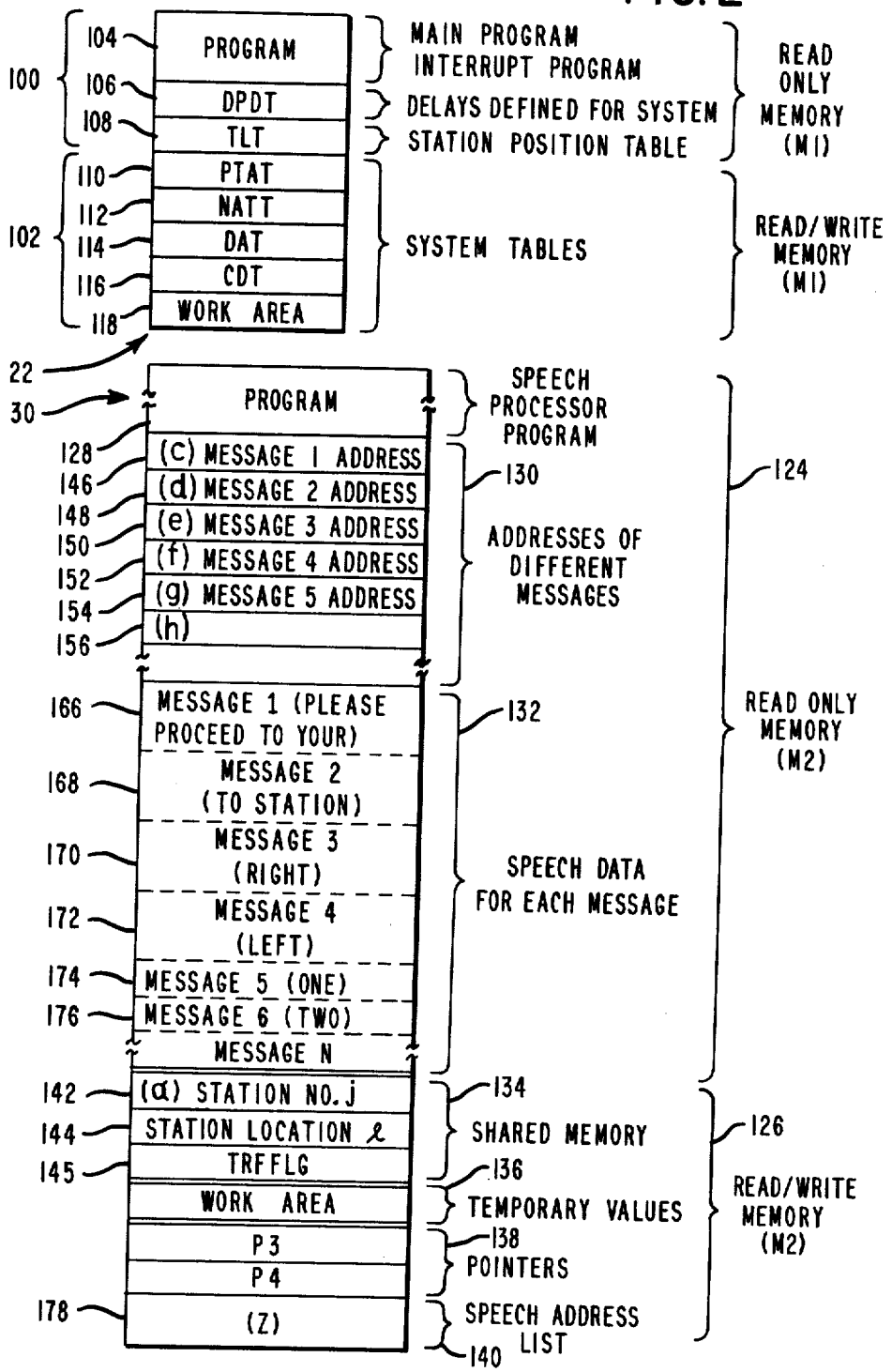
FIG. 2 is a diagram of the main processor memory and the speech processor memory, showing the type of information stored in the various sections of each memory.

Referring now to FIG. 2, the map of the memory 22, which is also referred to in certain portions of the description as "M1", is divided into a first read-only memory section 100 and a second read-write memory section 102. The contents of the read-only memory section 100 are determined during the design process for the system, and are written into the memory device before the device is incorporated into the system. Included in the read-only memory section 100 is a first area 104 in which the main and interrupt programs are stored.

Also included in the section 100 is an area 106 in which is stored the delay parameters definition table DPDT. This table defines a set value for each timer in the table CDT. The timers will be subsequently described in greater detail in the discussion of the table CDT.

Figures 3, 4, 5:
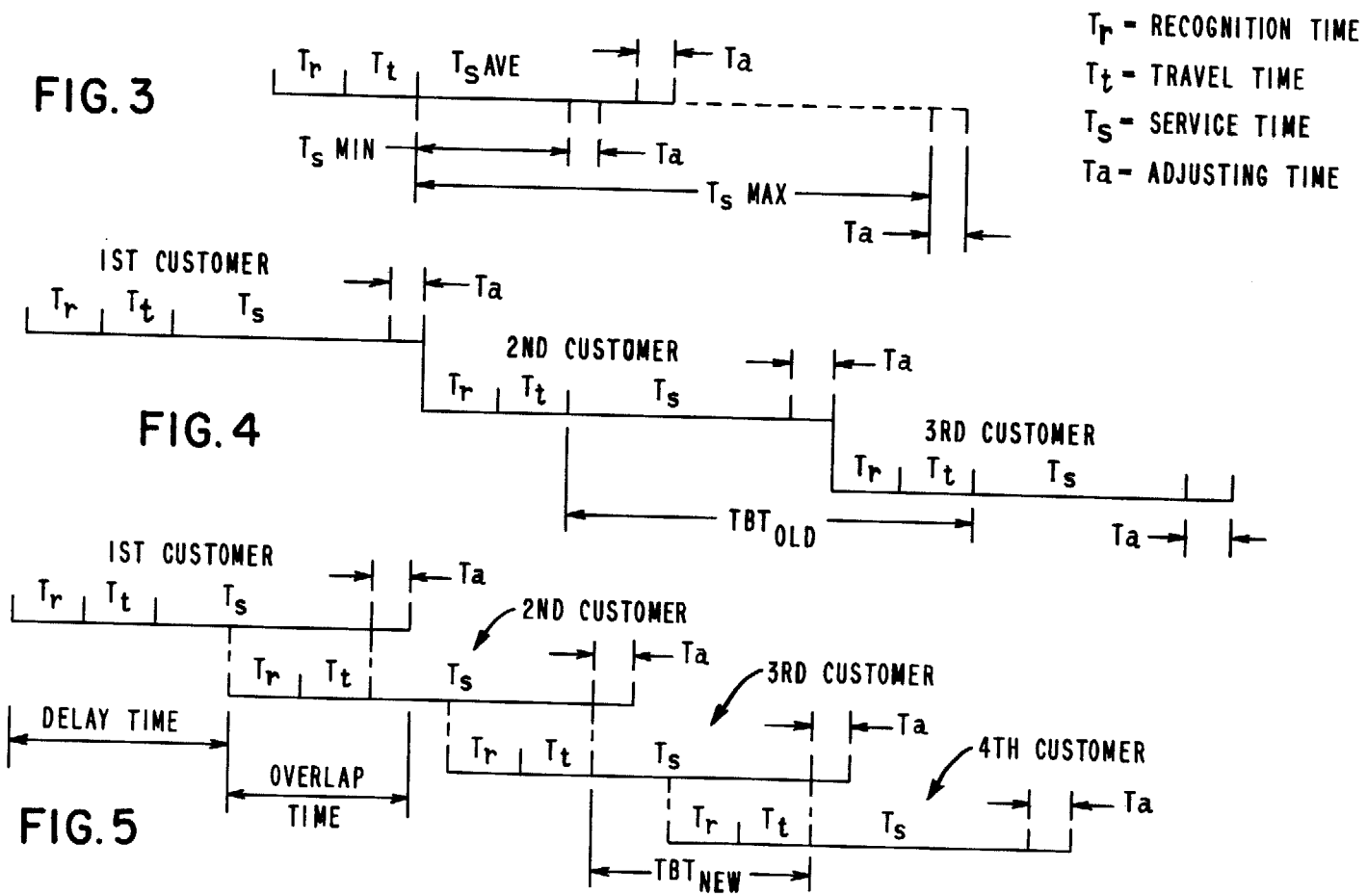
FIGS. 3, 4 and 5 are diagrams showing the manner in which the time utilized in a customer service transaction is divided into various categories under various methods of customer queue control.

The manner in which the values for the timers for the table DPDT are determined will now be described. Shown in FIG. 3 is a diagram depicting the various time elements which make up a typical service station transaction, and the relationship of these elements. These elements include recognition time ($T_r$), travel time ($T_t$), service time ($T_s$) and adjusting time ($T_a$). Recognition time is time spent by the customer to recognize that one or more service stations is available and to select the nearest available service station. Travel time is required to move from the head of the queue to the selected service station. Service time is taken in serving the customer at the station and may vary substantially, as shown by the "maximum" $T_{S\,MAX}$, "minimum" $T_{S\,MIN}$, and "average" $T_{S\,AVE}$ lengths shown in FIG. 3. After finishing a transaction, the customer remains at the station for another interval (the adjustment time) before leaving.

In FIG. 4, the total time span is shown for serving a plurality of customers utilizing a standard method in which service of one customer is not begun until service of the preceding customer has been completed. In such a case, it will be seen that the Time Between Transactions ($TBT_{OLD}$) for such a method is:

$$TBT_{OLD}=T_r+T_t+T_s+T_a$$

In FIG. 5, the method of the present invention is illustrated diagrammatically. The periods of customer service are overlapped, so that the Total Transaction Time (equivalent to $TBT_{OLD}$) is equal to a delay time plus an overlap time. An appropriate value for the delay time is computed in each case, utilizing a mathematically determined constant "C", so that the Time Between Transactions ($TBT_{NEW}$), for the method of the present invention is:

$$TBT_{NEW}=T_r+T_t+C.T_s$$

As indicated above, Total Transaction Time is equal to Delay Time plus Overlap Time, where:

Total Transaction Time $=T_r+T_t+T_s+T_a$

Delay Time $=T_r+T_t+C.T_s$

Overlap Time $=T_r+T_t+T_a$

Combining these equations, the following value for C is obtained:

$$C=\frac{T_s-(T_r+T_t)}{T_s}$$

The factor C may then be determined for each service station according to statistical measurement of $T_r$, $T_t$ and $T_s$ for the environment in a given establishment. The value of C has been found normally to range between 0.75 and 0.90. For a given application, knowing the statistical means of $T_r$, $T_t$ and $T_s$, represented by $\overline{T}$, $\overline{T_t}$ and $\overline{T_s}$, respectively, the factor C is computed from:

$$C=\frac{\overline{T_s}-(\overline{T_r}+\overline{T_t})}{\overline{T_s}}.$$

The travel time $T_t$ is a function of the distance between the service station and the main queue. A smaller value of C tends to build the local queue for that service station to the maximum of two customers. On the other hand, a larger value for C will tend to utilize the station less efficiently. The values for the delay times to be defined for table DPDT are computed from:

$$DPDT(j)=\overline{T}_{rj}+\overline{T}_{tj}+C_j\,\overline{T}_{sj},$$

for each station j.

Also included in the read-only memory section 100 is an area 108 in which is stored the station position definition table TLT. This table indicates the positions of the various service stations with reference to the direction in which a customer must proceed in moving from the head of the main queue to the local queue at the selected station; that is, either to the left or to the right. The number of positions in the table TLT is equal to the number of service stations, and the value stored in each position is either 0, indicating a station to the left of the main queue; or 1, indicating a station to the right of the main queue.

Included in the read-write memory section 102 of the memory 22 is a first area 110 in which is stored the present station activity table PTAT. This table indicates the activity at each station local queue. The number of positions in the table PTAT is equal to the number of service stations, and the value stored in each position is either 0, 1 or 2. If the value is 0, this indicates that the station has no customers; if the value is 1 or 2, this indicates the number of customers at the station in the local queue. The table is initialized to 0. When a customer in the main queue is dispatched to a station j, the value of the position j of table PTAT is increased by one. When the operator of a station j has actuated an "open" key 52 and there is at least one customer in its local queue, then the value of position j of table PTAT is decreased by one.

Also included in the read-write memory section 102 of the memory 22 is an area 112 in which is stored the next available station table NATT. This table contains a list of available service stations and indicates in which order these service stations will serve incoming customers. The number of positions in the table NATT is equal to the number of service stations, and the contents of the various positions are the identifying numbers of the various service stations. The relative positions indicate the order in which the service stations will be assigned, with the identifying number of the next available service station being in the first position. The table is initialized to 0, indicating that no service station is available. A pointer P denotes the next available entry. After the initializing operation, P is equal to 1.

If the station number j in the first position of the table NATT is not 0, then the customer at the head of the queue will be assigned to that station. Once that station has been assigned, all of the entries in the table NATT between positions 2 and P are shifted one position to the left and P is decreased by 1, thus removing from the table NATT the service station number formerly in the first position.

When a station is closed, its identifying number j is removed from the table NATT, and the table is adjusted by shifting all entries between the position corresponding to j plus 1, and P, one position to the left. The value of position P is then decreased by 1.

Also included in the read-write memory section 102 of the memory 22 is an area 114 in which is stored the delay activity table DAT. The function of this table is to specify which station numbers have active timers in the table CDT. Position j in the table DAT indicates the station number. The contents of table DAT indicate which timers in the table CDT are active. Each position DAT(j) may equal either 0, 1, 2 or 3. The value 0 means that the timer in table CDT is not active; the value 1 means that the timer is active; the value 2 means that the station operator has depressed the "open" key and either that the station has opened or that the operator has removed one customer from the local queue; and the value 3 means that the station operator has depressed the "close" key. The table DAT is initialized to 3.

Also included in the read-write memory section 102 of the memory 22 is an area 116 in which is stored the countdown delay table CDT. The function of this table is to indicate the amount of time remaining for each station until the next customer in the main queue can be dispatched to that associated local queue. A software timer is contained in this table for each service station. The table CDT contains a number of positions which is equal to the number of service stations, and the contents of each position has a value which indicates the amount of time left at a given instant in the timer assigned to that position. The range of values for the time t for each position varies from the delay value for that position stored in the table DPDT, to 0. The table CDT is initialized by setting each position to the corresponding delay value stored in the table DPDT. During system operation, when the value of a given position of table CDT times out to 0, and there are less than two customers in its local queue, then that station number is entered at position P of table NATT, the entry value of that position of table CDT is reset to the corresponding value in table DPDT, and the corresponding position of table DAT is set to 0.

Also included in the read-write memory section 102 of the memory 22 is a work area 118, for storage of variable values such as the station number j, the variable value p used in removing the teller number from the table NATT, and the value P used in the interrupt service routine.

The speech processor memory 30, which is also referred to in certain portions of the drawings and description as M2, is implemented with two types of memory elements, the read-only memory section 124, and the read/write memory section 126. The contents of the read-only memory section 124 are determined during the design process for the system, and are written into the memory device before the device is incorporated into the system. Three separate areas of the read-only memory section 124 are defined in FIG. 2. Area 128 contains the speech processor program shown in FIG. 8. Area 130 contains a number of locations providing message addresses. A message address indicates the starting address in memory where the speech data for this message can be found. Area 132 contains the speech data for the different messages required by the operating environment in which the system is utilized. The speech data, when clocked in a serial bit stream in the signal DIGIDATA and delivered to the speech synthesizer 80 (FIG. 1) will cause the synthesizer to generate an analog signal containing the necessary information to reproduce the spoken message.

The contents of the read-write memory section 126 are the variable elements of the system. The shared memory portion 134 is addressed by both processors 20 and 28. Processor 20 selects this memory to transfer the service station number j, the location 1 of the service station from memory 22, and to indicate that new data are available by setting the transfer indicator TRFFLG equal to one. Memory area 136 contains temporary values required by the speech processor program. Memory area 138 contains pointers P3 and P4. Pointer P3 marks a position in the speech address list 140. Pointer P4 marks a position in the speech data section 132. The speech address list 140 stores the starting addresses of the various messages in section 132 necessary to assemble spoken instructions to be delivered to the customer at the head of the main queue.

Returning now to the read-only memory section 124 of the memory 30, a brief summary of the various locations is provided. Locations 146, 148, 150, 152, 154, 156 contain the addresses of areas 166, 168, 170, 172, 174, 176, respectively. These areas 166–176 of the memory 30 contain the speech data for messages 1–6 respectively. Returning to the read/write memory section 126, location 142 of memory 30 contains the station number of the selected station. Location 144 of the memory 30 contains the selected station location direction. The value at the location can be either 0 or 1, indicating that the station is located to the right or the left of the main queue. Location 145 contains the transfer indicator TRFFLG. Area 178 contains the speech address list. This list is compiled every time that the speech processor is activated, in order to deliver the next spoken message with the correct teller number and location.

Let it now be assumed that the main processor 20 transfers from the memory 22 to the memory 30 at locations 142 and 144 the teller number 2 and the location 1 respectively. The speech address list 140, starting with the address at the beginning of the area 178 will contain the starting addresses of areas 166, 172, 168, 176. This corresponds to the following voice message:

"Please proceed to your, left, to station two."

The manner in which the system of the present invention functions to select a local queue and to generate a voice message to direct a customer at the head of the main queue to the selected local queue is best explained by reference to the flow diagrams of FIGS. 6A, 6B, 6C, 7, 8A and 8B.

Figure 6A:
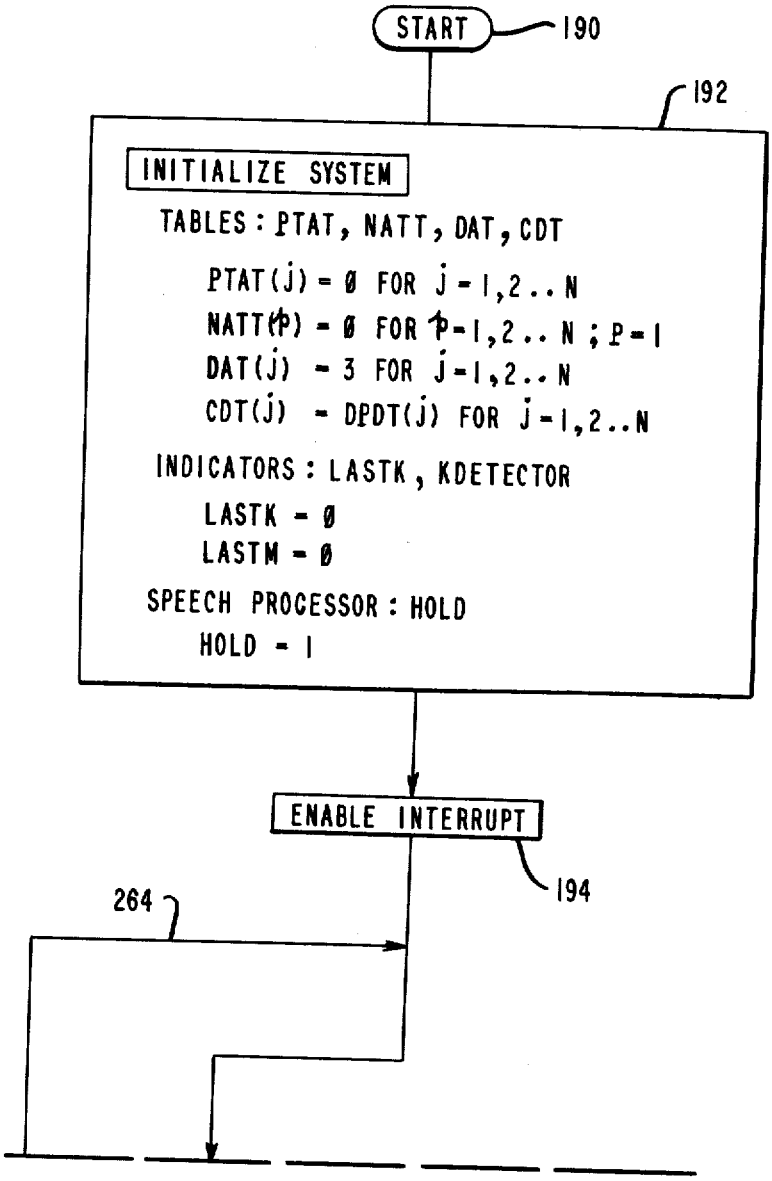
FIGS. 6A, 6B and 6C comprise a flow diagram for the main processor customer queue control program.

Referring now to FIG. 6A, the operation of the system is commenced at the start position of the main program, represented by block 190. A number of initialization operations are first performed, as indicated in block 192. The contents of Table PTAT are set equal to 0 for all station positions j, indicating that all stations have no customers at their local queues. The contents of Table NATT are set equal to 0, and its associated pointer P is set equal to 1, indicating that no station is available. The contents of Table DAT are set equal to 3 for all station positions j, to indicate that all stations are closed. The contents of Table CDT are set to the values stored in the Table DPDT. CDT(j) is equal to DPDT(j), which represents the amount of time between the assignment of a customer to the local queue of a given station and the assignment of the next customer to the local queue for that station. The indicator LASTK is set equal to 0, to indicate that processing for the last customer has been completed. The indicator LASTM is set equal to 0 to indicate that there is no message for the speech processor. The hold signal line which indicates a hold state for the speech processor 28 is set equal to one.

Once the initialization operations of block 192 have been completed, the interrupt function is enabled, as indicated in block 194 of the flow diagram of FIG. 6A. This involves a gating operation which permits the "open" and "close" keys 52, 54 of the various service stations 40–50 to affect control of the system operation.

After completing initialization, the system enters what may be considered to be a "normal" condition, which consists of two states, updating of timers and monitoring of customer presence at the head of the main queue.

Each time a station operator presses one of the "open" or "close" keys 52 or 54, the normal condition of the system is interrupted and the system enters a routine to service the operator request. Once this routine is completed, the operation returns the system to the point at which it left the normal condition.

In the updating of timers in table CDT, the active timers, represented by DAT(j)=1, are decreased by t units of time, where t is a function of the number of instructions performed between two successive updates. If a particular active timer CDT(j) equals 0, the station number j is entered in the available teller list in Table NATT and the CDT(j) and DAT(j) values are then reinitialized. This is accomplished by the portion of the process indicated in the dashed line block 196 of FIG. 6B, which will now be described in greater detail. As indicated in block 198, the value of j, relating to a service station number, is set equal to 1. System operation then proceeds to decision block 200, where position j of the delay activity table DAT, designated on flow diagram of FIG. 6B A as DAT(j), is tested to determine whether or not it is equal to 0 or 3. If it is equal to 0 or 3, the software timer for that station is not active, and if the value is not equal to 0 or 3 then the timer is active.

Assuming that DAT(j) is not equal to 0 or 3, the process proceeds to decision block 202, where DAT(j) is tested to determine whether or not it is equal to 2, which would mean that the operator of station j has depressed the "open" key 52. Assuming that DAT(j)=2, the process proceeds to decision block 204, where it is determined if station j is present in table NATT; if present, signified by NATT(p)=j, the process continues to block 205 where the value of DAT(j) is set to 0. From block 205 the process proceeds to block 216. If j is not present in table NATT, operation proceeds to decision block 209, where the equivalance of PTAT(j) to zero is tested to determine whether a customer is present at the local queue j. If no customer is present at the local queue, the operation proceeds sequentially through blocks 206, 208, 210, 212 and 214 to decision block 216. First, in block 206, the interrupt function is disabled. In block 208, the Table NATT is updated by first shifting all values between NATT(l) and NATT(P) one position to the right, and then making the value of position 1 equal to j. This has the effect of making station j the next station to be selected. In block 210, the value of P is incremented by 1, and position P of Table NATT is made equal to 0. In block 212, DAT(j) is set equal to 0 and CDT(j) is set equal to DPDT(j), and in block 214, the interrupt is enabled once again.

The process then proceeds to the decision block 216, in which the value of j is tested for equality with N, which, it will be recalled, is the total number of service stations. If j is not equal to N, the process loops back on path 218 to block 220, in which j is incremented by 1, and then back over path 222 to the previously-described decision block 200, after which the process is repeated with the greater value of j. This looping continues until j is found to be equal to N in decision block 216, so that the status of all stations is ascertained and they are appropriately positioned in the Table NATT. When j is determined in decision block 216 to be equal to N, the process then proceeds on path 224 to decision block 226 (FIG. 6C), for generation of customer-directing messages where appropriate, as will subsequently be described.

Returning now to decision block 202, it will be noted that if DAT(j) is not equal to 2, the process continues to block 207 where the value of CDT(j) is tested for equivalence to a negative value. If so, operation continues to block 234. If not, then the delay time for station j is decremented in block 228 by t, which, as previously stated, is a function of the number of instructions performed between two successive updates. The process then proceeds to block 230, where the equality of CDT(j) to 0 or negative is tested, to determine whether any time remains on this timer. If not, the process proceeds over path 232 to the previously-mentioned decision block 116.

If CDT(j) is equal to 0 or negative, the process continues to decision block 234, where the value of position j of the Table PTAT is tested for equality with 2. If such equality exists, this indicates that two customers are already present in the local queue associated with that service station, and the process therefore proceeds over path 236 to block 239, where the value of CDT(j) is set to minus one. From there, the process continues to the decision block 216. If the value of position j of Table PTAT is not equal to 2, the process proceeds sequentially to a disable interrupt block 238, a block 240 in which position P of the Table NATT is set equal to j, and through the previously-mentioned blocks 210, 212 and 214, incrementing the value of P by 1, setting NATT(P) equal to 0, setting DAT(j) equal to 0, setting CDT(j) equal to DPDT(j), reenabling the interrupt, and then proceeding to the decision block 216.

In block 209, if the value of PTAT(j) is not 0, operation proceeds to blocks 238, 240, 210, 212, 214 and 216, previously described, and where station j is entered in the next available position of table NATT.

The system proceeds to block 226 where the equivalence of the hardware line KDETECTOR to 1 is tested. If such equivalence exists, it is established that there is at least one person in the main queue. If the equivalence does not exist, indicating that no customer is present in the main queue, the value LASTK is set equal to 0 in block 243, and the process returns over paths 242 and 264 to block 196 to update the timers.

Assuming that KDETECTOR=1, the system proceeds to decision block 244, in which the equivalence of LASTK to 1 is tested. This determines whether or not there is already a customer who has been previously detected. If not, an inquiry is made of Table NATT to see whether any station jj is available for this customer, this being done in decision block 246. The value jj, as used here, represents the station number in the first position in the table NATT, which will be assigned to the next customer in the main queue. The first position in Table NATT is examined and if the position is other than 0, then a station is available to service the customer at the head of the queue. If there is no station available, the system proceeds back over paths 248 and 264 to update the timers as previously described in connection with block 196. Assuming that a service station is availabie, the value LASTK is set equal to 1 in block 250. Interrupt is then disabled in block 252 and the value of jj is set to equal position 1 of the Table NATT in block 254. Next, in block 256, the position value p of Table NATT is made equal to the value of position p+1 for positions p being equal to positions 1, 2 up to position P. P is made equal to P-1 in block 258, and the value of NATT(P) is made equal to 0 in block 260. This has the effect of removing service station jj from the Table NATT. Subsequently, the value of LASTM is set equal to 1 in block 262, signifying that a message must be sent to the customer at the head of the main queue. Interrupt is then enabled in block 263 and from there, over path 264, the system loops back to update the timers in block 196.

After updating the timers is completed, the system returns to decision block 226 to ascertain whether KDETECTOR is equal to 1. This value will remain 1 because the customer is still standing at the head of the queue. The system proceeds to block 244 where a test is made as to whether or not LASTK is equal to 1, which will be the case because it has previously been set to 1. The system then proceeds to decision block 266, where the equivalence of the value LASTM to 0 is tested. This constitutes an inquiry as to whether or not the message for this customer has been delivered. LASTM has been set to value 1 in block 262, so that the "No" branch from block 266 is taken, leading to decision block 268. A determination here is made as to whether or not the speech processor is available, and this is done by checking the hardware line BUSY. If this line is not equal to 0, then the speech processor 28 is not free and the system returns over paths 270 and 264 to update the timers in block 196. If the speech processor is free, or not busy, the "Yes" branch from the block 268 is taken. In block 272, HOLD is set equal to 1, so that the speech processor 28 is put into a hold state, which means that the speech processor will release busses 32 and 34 of FIG. 1 for use by the processor 20. In block 274, busses 32 and 34 are enabled by making hardware signal B12 for the buffers 36 and 38 equal to 1. The system then transfers the station number jj and the position of the station location from the processor 20 to the memory 30, and sets the transfer indicator TRFFLG equal to one. This is accomplished by setting memory location 142 of the memory 30 equal to TLT(jj) in block 278, and by setting memory location 144 in the memory 30 equal to jj, which is the station number, in block 280, and by setting memory location 145 of memory 30 equal to one. The value of TLT(j) is either 0 or 1, indicating that the selected station is either to the right or to the left of the main queue. When these settings have been accomplished, the busses 32 and 34 are released, by setting the signal B12 equal to 0 in block 282. The signal HOLD is set equal to 0 in block 284, freeing the speech processor to function and to deliver the message. The process then proceeds to block 286 in which the value LASTM is set equal to 0 to signify that the message has been delivered. Interrupt is then disabled in block 287 and the timer for the selected station is then activated by setting DAT(jj) equal to 1 in block 288, and the new customer is added to the local queue total for the station j by setting PTAT(jj) equal to PTAT(jj)+1 in block 290. In block 291 interrupt is enabled and from this block, the process continues over paths 292 and 264 to return to block 196 for further updating of the timers.

Figure 6B:
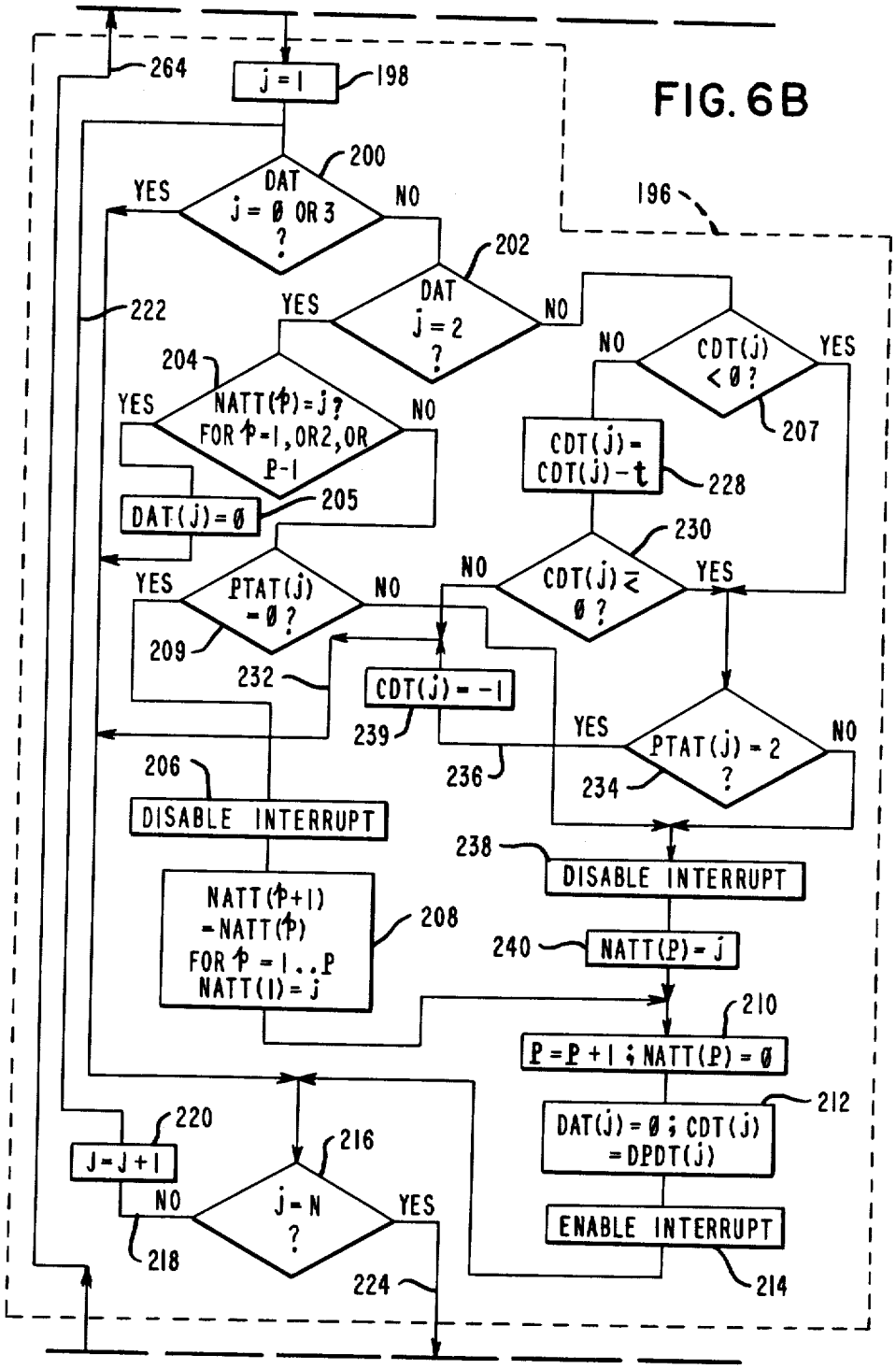
Figure 6C:
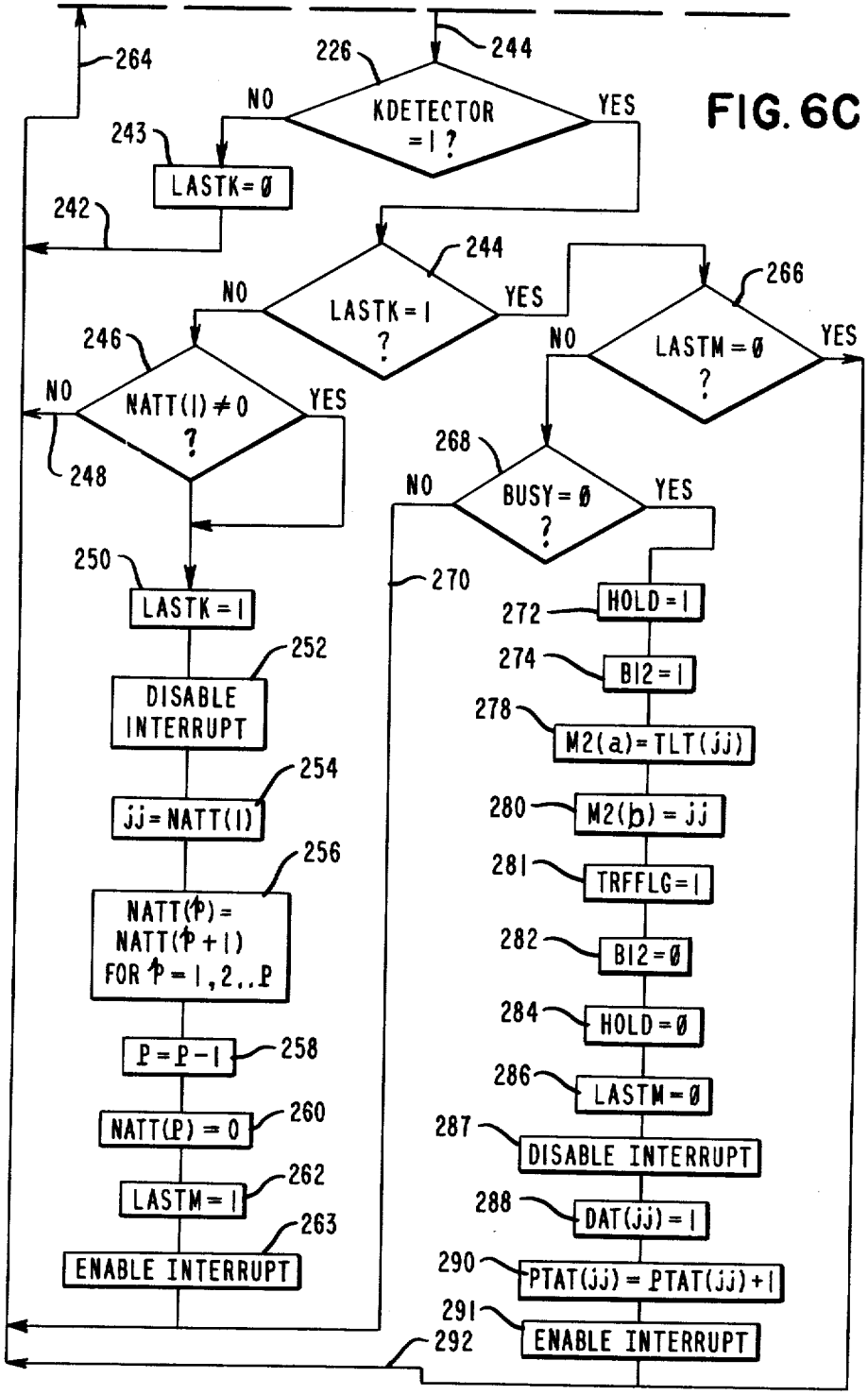

This concludes the description of the main program for the system, as contained in FIGS. 6A, 6B and 6C.

The manner in which the interrupt service routine functions to interrupt the main program is best explained by reference to the flow diagram of FIG. 7.

Referring to that Figure, the interrupt service routine becomes active each time that a service station operator depresses an "open" key 52 or a "close" key 54. It will be recalled from the previous description of the system of FIG. 1 that the signal resulting from the depression of a key 52 or 54 is transmitted to the switch detector and encoder 60, which generates a first signal INTR1 which is applied to the processor 20; a second signal OCF identifying the type of key depressed, which utilizes one of five parallel lines applied to the peripheral interface 62 from the switch detector and encoder 60; and a third signal utilizing the other four lines applied to the peripheral interface 62, which provides the identifying number of the service station in which the key 52 or 54 has been depressed. These data are entered into the processor 20 via bus 26.

Figure 7:
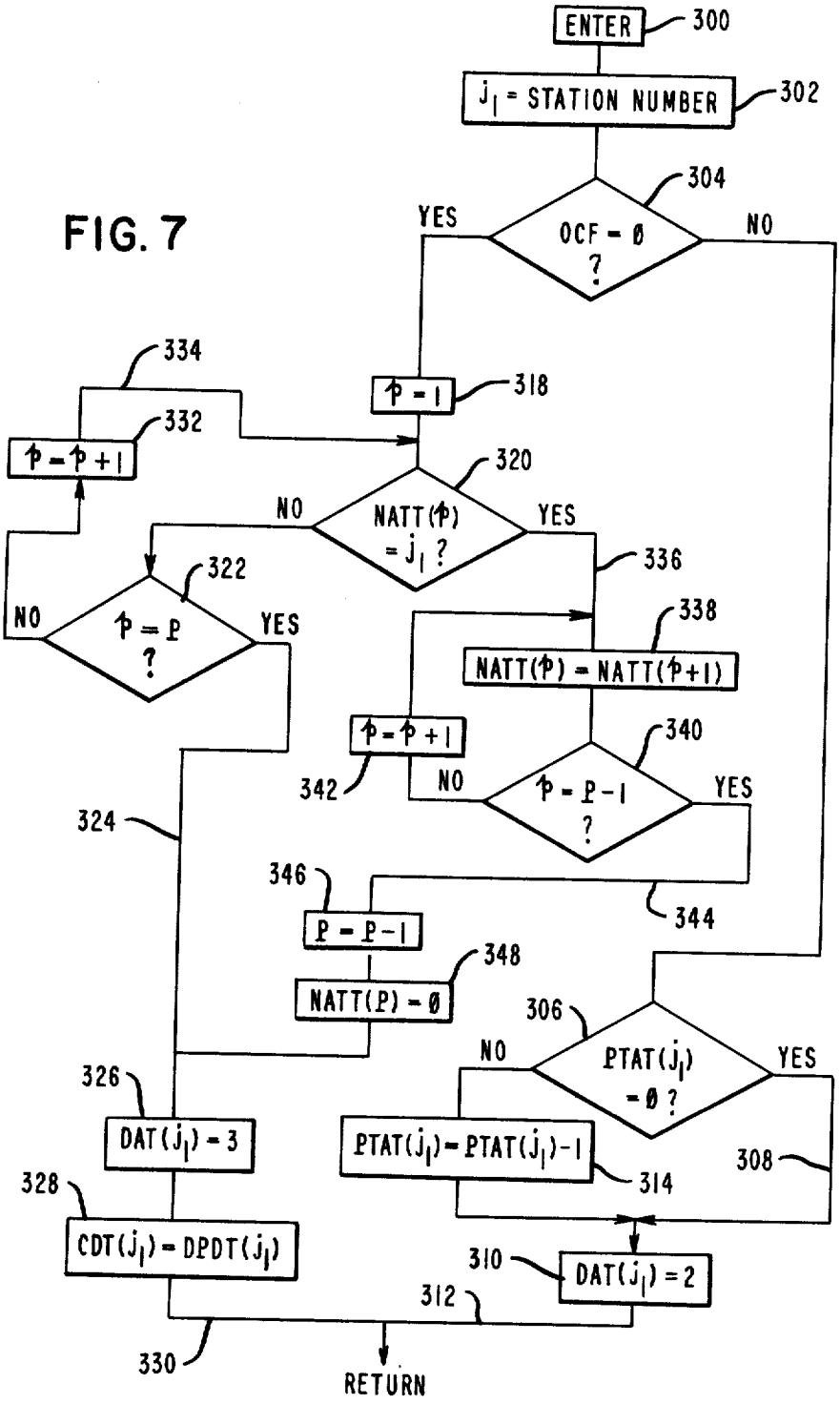
FIG. 7 is a flow diagram for an interrupt service routine for the program of FIGS. 6A, 6B and 6C.

Thus, in FIG. 7, the routine is entered in block 300, and $j_1$ (representing the specific station number that has actuated on "open" or "close" key) is set equal to the station number in block 302. The value of the signal OCF is tested in decision block 304 as to its equality to zero. If OCF is not equal to zero, indicating that the "open" key of the station was depressed, the process proceeds to decision block 306, where the equivalents of the value PTAT($j_1$) to 0 is tested. If PTAT($j_1$) is equal to zero, this means that there is no customer in the local queue, and the process continues via path 308 to the block 310, in which the value DAT ($j_1$) is set equal to 2 to indicate to the main program that station $j_1$ has actuated the "open" key. The routine then returns to the main program over the path 312. If the value PTAT($j_1$) is not equal to zero, meaning that there is at least one customer in the local queue, the process continues to block 314, in which the value of PTAT($j_1$) is decreased by one, removing one customer from the queue total. The process then continues to block 310, and over path 312 to return to the main program, as before.

If OCF is equal to zero, this means that the service station is closing, and that the station number $j_1$ must therefore be removed from the various tables. Proceeding from decision block 304, the station number $j_1$ will be removed, if present, from the table NATT. The value of DAT($j_1$) will be set equal to 3, indicating to the main program that station $j_1$ has closed. The value of the timer CDT($j_1$) will be reset to the value of DPDT($j_1$). To do this, p is set equal to 1 in block 318 and the process proceeds to the decision block 320, where the equivalence of NATT(p) to $j_1$ is tested. If NATT(p) is not equal to $j_1$, the process continues to the decision block 322, where the equivalence of p (table position) to P (total number of table positions) is tested. If p equals P, the system proceeds over path 324 to block 326, where DAT($j_1$) is set equal to three; then to block 328, where CDT($j_1$) is set equal to DPDT($j_1$), and then over path 330 to return to the main program.

If p does not equal P, p is incremented by one in block 332, and the process returns to decision block 320 over path 334. The equivalence of NATT(p) to $j_1$ is again tested in block 320. If there is no equivalence, the process proceeds to decision block 322 and continues the routine previously described, from that block. If NATT(p) equals $j_1$, the routine continues over path 336 to block 338, where the value NATT(p) is set equal to the value of NATT(p+1), and to decision block 340, where the equivalence of p to P-1 is tested. If p does not equal P-1, the process loops through block 342, where p is set equal to p+1, back to block 338. If p is equal to P-1 in block 340, the process continues over path 344 to block 346, where P is set equal to P-1, and then to block 348, where NATT(P) is set equal to zero. The process continues through previously-mentioned blocks 326 and 328 to the path 330, to return to the main program, as before.

This concludes the description of the interrupt service routine for the system, as contained in FIG. 7.

The manner in which the speech processor routine functions to control the system of FIG. 1 to produce voice messages to direct customers from a main queue to a selected one of a plurality of local queues will now be explained.

The speech processor 28 functions essentially as a "slave" of the main processor 20. For purposes of this description, let it be assumed that the system is ready to deliver a spoken message to the customer at the head of the main queue.

It is first necessary to transfer data consisting of the station number and the station location from the processor 20 to the processor 28. A "flag" designated TRFFLG which indicates whether or not such a transfer has taken place is located in the speech processor memory 30. The processor memory 30 is also designated and referred to in the flow diagram of FIGS. 8A and 8B, and in the ensuing description, as M2. No data transfer is indicated by setting TRFFLG equal to zero, while setting TRFFLG equal to one indicates that data have been transferred.

The processor 20 sets the value of the HOLD line equal to one in order to indicate a request for use of the address bus 32 and the data bus 34. The speech processor 28, upon receiving the HOLD request, relinquishes use of these buses as soon as any current bus data transfers are completed.

The processor 20 sets the value of the line B12 equal to one in order to condition buffers 36, 38 to connect bus 24 to bus 32 and to connect bus 26 to bus 34. The processor 20 then transfers the value of the selected service station number and location to the Speech Processor Memory 30, and sets the value of the flag TRFFLG to equal one. Following this, the busses 24 and 26 are disconnected from the busses 32 and 34, respectively, by setting the value of the line B12 equal to zero. The HOLD condition is then removed by the processor 20 by setting HOLD equal to zero, so that the Speech Processor 28 regains access to its busses 32 and 34. The processor 20 then continues with the execution of the main program of FIGS. 6A, 6B and 6C, while the speech processor 28 processes the message and delivers the speech data to the speech synthesizer 80.

Figure 8A:
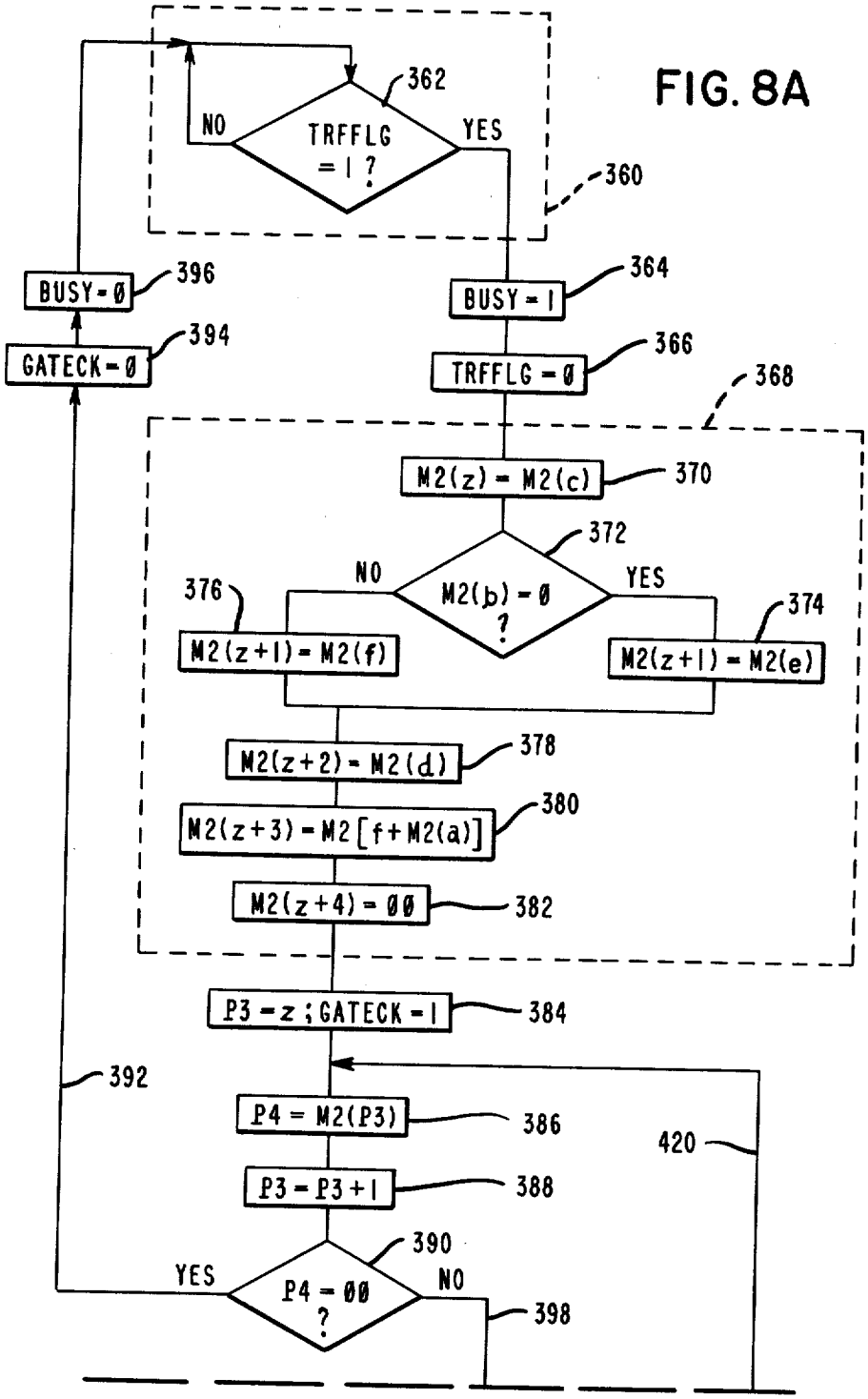
FIGS. 8A and 8B comprise a flow diagram for the speech processor program.
Figure 8B:
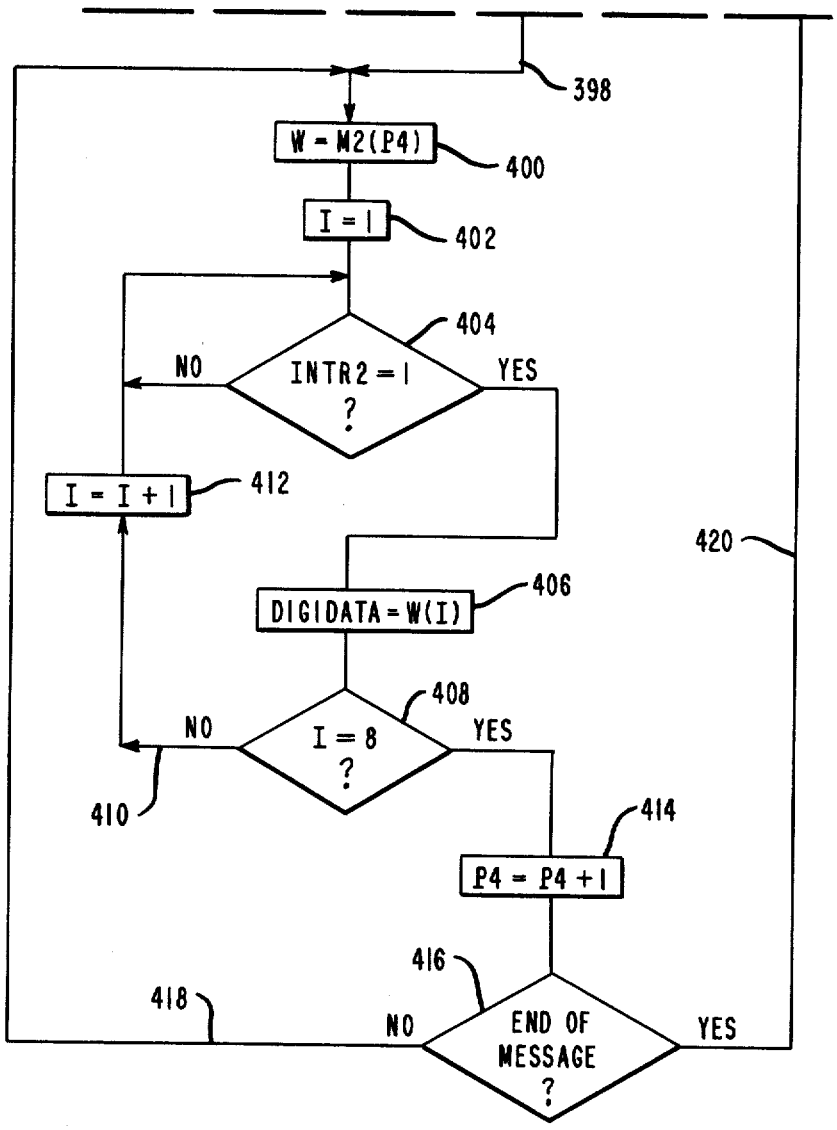

Operation of the system by the speech processor program may best be understood by reference to the flow diagram of FIGS. 8A and 8B. Block 360 of this diagram represents an "idle" state, in which the processor 28 will be, when a message has been delivered, and it is waiting for new data constituting the next message to be transmitted from the processor 20.

In decision block 362 of block 360, the equivalence of the value of TRFFLG to one is tested. So long as TRFFLG is equal to zero, the idle condition continues. When TRFFLG becomes equal to one, new data is present in the memory 30, and the process proceeds to block 364, where the BUSY line is set equal to one, to inform the processor that the speech processor 28 is entering the BUSY state. In block 366, the flag TRFFLG is set equal to zero.

The process then continues to the dashed block 368, in which the message addresses are compiled in the section designated by the reference character 178 of the memory 30. First, in block 370, the contents of M2(c), that is, the starting address of Message 1 ("PLEASE PROCEED TO YOUR"), found in location 146 of memory 30 (FIG. 2), is entered in M2(z), that is, the speech address list, designated by reference character 178 in the memory 30. Value z is the starting address of the speech address listed section.

In decision block 372, the equivalence of M2(b), that is, the contents found in location represented by reference character 144 in the memory 30, to zero is tested. It will be recalled that the value at M2(b) determines the position of the selected service station, whether to the right or the left of the main queue. If the value found at M2(b) is equal to zero, the process proceeds to block 374, in which the second location of the speech address list, represented by M2(z+1) is provided with the address of Message 3 ("RIGHT"), stored in location e, designated by reference character 150 (FIG. 2). If the value found at M2(b) is not equal to zero, the process proceeds to block 376, in which the second location of the speech address list, represented by M2(z+1) is provided with the address of Message 4 ("LEFT"), stored in location f, designated by reference character 152 (FIG. 2).

From either of the blocks 374 or 376, the process continues to block 378, in which the third location of the speech address list, represented by M2(z+2), is provided with the address of Message 2 ("TO STATION"), stored in location d, designated by reference character 148 (FIG. 2).

The process then continues to block 380, in which the fourth location of the speech address list, represented by M2(z+3), is provided with an address stored in the location of memory 30 determined by adding the address f to the value of the selected service station stored in location a (reference character 142). Thus, if service station number one were selected, the value of address f would be increased by one, which is address g (reference character 154), which contains the Message 5 address. In location 174 (FIG. 2), it will be noted that Message 5 is "One", which is the number of the selected station.

The process then continues to block 382, in which the fifth location of the speech address list, represented by M2(z+4), is set equal to zero to signify the end of the message.

The process proceeds to block 384, in which the value of register P3 (contained in section 138 of memory 30) is set equal to z, the starting address of the speech address list. Also in block 384, the line GATECK applied to the gate 86 (FIG. 1) is set equal to one, thus passing the signal CKS from the timer 84 to the speech synthesizer 80.

Next, as seen in block 386, the value found at location addressed by register P3 is put into the register P4 (also in location 138 of the memory 30). In block 388, the value stored in the register P3 is increased by one. The register P3 points to the starting address of the next message, and the register P4 contains the address of the present message to be delivered.

The process proceeds to decision block 390 in which the equivalence of P4 to 0 is tested. If P4 is equal to 0, all of the messages in the speech address list have been delivered, and the operation continues over path 392, setting GATECK equal to 0 in block 394, setting BUSY equal to 0 in block 396, and returning to the idle state represented in block 360.

If P4 is found not to be equal to 0 in block 390, the process continues over path 398 to block 400 (FIG. 8B) in which a memory word W, which contains eight bits of data, located in the work area found in area 136 of memory 30, is set equal to the value found at memory 30 location indexed by P4. It may be noted that some or all of the various messages contained in locations 166 to 176 of the memory 30 may be the equivalent of a number of words W in length, and that these messages are therefore transmitted from the memory 30 to the speech synthesizer 80 in a number of serial eight bit segments. Memory location W acts as a one-word buffer for the speech data contained in the memory 30. The eight bits of speech data contained in the word W are shifted serially out on the line DIGIDATA to the speech synthesizer 80. The bit position to be accessed in the word W is signified by the value I, which is embodied in an eight bit software counter situated in work area location 136 of the memory 30. The value I is initialized to 1 in block 402.

The process proceeds to decision block 404, where further operation awaits the application of a signal INTR2 to the processor 28 from the pulse generator 88 (FIG. 1). So long as the signal INTR2 is not equal to one, the process cycles through the decision block 404. When INTR2 becomes equal to one, the process continues to block 406, where the signal DIGIDATA is set equal to bit I of word W, and then to decision block 408, where the equivalence of I to 8 is tested. If I is not equal to 8, the process loops from the decision block over the path 410 to the block 412, where the value of I is incremented by one, and then back to decision block 404, so that all eight bits of the word W are serially included in the signal DIGIDATA. If I is found to be equal to 8 in block 408, then the value P4 is increased by 1 in block 414, and the process proceeds to decision block 416, where a determination is made as to whether the end of the message has been reached. If it has not been reached, the process loops back over path 418 to block 400, where W is set equal to M2(P4), comprising the next eight bits of speech data, and then proceeds as previously described to serially output this data in the signal DIGIDATA to the speech synthesizer 80.

If the message is found in block 416 to be completed, the process loops back over the path 420 to the block 386, where P4 is set equal to M2(P3), representing the starting address of the next message, and then continues as previously described.

Reference may be had to an article entitled "Tired of Just Reading Results? Let Your Instrument Do the Talking" appearing on pages 160 to 162 of the Nov. 22, 1978 issue of "ELECTRONIC DESIGN", Volume 24, which describes a speech implementation somewhat similar to that described above.

This concludes the description of the speech processor routine for the system, as contained in FIGS. 8A and 8B.

Below are program listings for the main program and the interrupt service routine written in BASIC language for use on a NCR 8140 data processing system.

NCR-DPS BASIC INTERPRETER VERSION 02.01.00 80/12/03

```
00010  REM QUEUE MANAGEMENT SYSTEM
00020  REM
00030  DIM PTAT(4),NATT(5),DAT(4),CDT(4),DPDT(4),TLT(4)
00040  DIM TX(4)
00050  REM N IS NUMBER OF STATIONS, T IS ELAPSED TIME
           BETWEEN UPDATES
00060  REM ELAPSED TIME T IS COMPUTED THROUGH TX,DX,
           ADN D
00070  REM   TX CONTAINS ELAPSED TIME FOR EACH STATION J,
00080  REM   DX VARIABLE DEFINES STATION ACTIVITY,AND
00090  REM   D VARIABLE CONTAINS TIME ELAPSED BETWEEN
             UPDATES.
00100  N = 4
00110  REM GET DELAYS AND POSITIONS FOR EACH STATION
00120  FOR I = 1 TO N
00130  READ DPDT(I)
00140  NEXT I
00150  FOR I = 1 TO N
00160  READ TLT(I)
00170  NEXT I
00180  REM
00190  REM ----------------------------------------------
00200  REM INITIALIZE SYSTEM
00210  REM ----------------------------------------------
00220  REM
00230  FOR J = 1 TO N
00240  PTAT(J) = 0
00250  NATT(J) = 0
00260  DAT(J) = 3
00270  CDT(J) = DPDT(J)
00280  TX(J) = 0
00290  NEXT J
00300  P = 1
00310  LASTK = 0
00320  KDET = 0
00330  D = 0
00340  REM ----------------------------------------------
00350  REM     LINK TO MACHINE LANGUAGE ROUTINE
00360  REM LINK 103 ENABLES INTERRUPT IN P1 TO ACCEPT
00370  REM INPUTS FROM STATIONS J.
00380  REM ----------------------------------------------
00390  REM
00400  LINK 103
00410  REM ----------------------------------------------
00420  REM UPDATE COUNTERS AND DETERMINE IF ANY STATION
           BECOMES
00430  REM AVAILABLE.
00440  REM ----------------------------------------------
00450  J = 1
00460  DX = 0
00470  D = D + 3
00480  IF DAT(J) = 0 OR DAT(J) = 3 GOTO 790
00490  DX = 1
00500  D = D + 2
00510  IF DAT(J) = 2 GOTO 840
00520  D = D + 2
00530  IF CDT(J) < 0 GOTO 610
```

-continued

NCR-DPS BASIC INTERPRETER VERSION 02.01.00 80/12/03

```
00540  REM UPDATE TABLE TX BY D UNITS
00550  GOSUB 1950
00560  REM REDUCE DELAY FOR STATION J
00570  CDT(J) = CDT(J) - T
00580  D = D + 4
00590  IF CDT(J) > 0 GOTO 790
00600  D = D + 2
00610  IF PTAT(J) = 2 GOTO 1130
00620  REM STATION J TIMES OUT - ADD J TO NATT
00630  REM ----------------------------------------------
00640  REM     LINK TO MACHINE LANGUAGE ROUTINE
00650  REM LINK 112 DISABLES INTERRUPT TO AVOID SIMUL-
           TANEOUS
00652  REM CHANGES IN WORKING TABLES.
00660  REM ----------------------------------------------
00662  LINK 112
00670  NATT(P) = J
00680  D = D + 3
00690  P = P + 1
00700  NATT(P) = 0
00710  DAT(J) = 0
00720  CDT(J) = DPDT(J)
00730  REM ----------------------------------------------
00740  REM     LINK TO MACHINE LANGUAGE ROUTINE
00750  REM LINK 103 ENABLES INTERRUPT
00760  REM ----------------------------------------------
00765  LINK 103
00770  REM
00780  D = D + 6
00790  D = D + 2
00800  IF J = N GOTO 1200
00810  J = J + 1
00820  D = D + 1
00830  GOTO 470
00840  REM STATION J ACTIVATED OPEN SWITCH, DETERMINE
00850  REM     IF J IS PRESENT IN TABLE NATT.
00860  L = 0
00870  FOR I = 1 to P - 1
00880  IF NATT(I) = J THEN L = 1
00890  D = D + 3
00900  NEXT I
00910  IF L = 1 GOTO 1170
00920  REM ENTER J1 in NATT(1)
00930  D = D + 2
00940  IF PTAT(J) > 0 GOTO 670
00950  REM STATION J NOT IN TABLE NATT
00960  REM     SHIFT RIGHT CONTENTS OF NATT AND
00970  REM     ENTER J AT POSITION ONE.
00980  REM
00990  REM ----------------------------------------------
01000  REM     LINK TO MACHINE LANGUAGE ROUTINE
01010  REM LINK 112 DISABLES INTERRUPT.
01020  REM ----------------------------------------------
01025  LINK 112
01030  REM
01040  I = P
01050  NATT(I + 1) = NATT(I)
01060  I = I - 1
01070  D = D + 2
01080  IF I > 0 GOTO 1050
01090  NATT(1) = J
01100  D = D + 1
01110  GOTO 690
01120  REM FLAG TIME OUT CONDITION FROM STATION J.
01130  CDT(J) = -1
01140  D = D + 1
01150  GOTO 790
01160  REM STATION J ALREADY PRESENT IN TABLE NATT.
01170  DAT(J) = 0
01180  D = D + 1
01190  GOTO 790
01200  REM
01210  REM ----------------------------------------------
01220  REM CHECK IF CUSTOMER IS PRESENT AT HEAD OF MAIN
           QUEUE
01230  REM SET KDET VALUE TO ONE IF CUSTOMER PRESENT
01240  REM ----------------------------------------------
01250  REM ----------------------------------------------
01260  REM     LINK TO MACHINE LANGUAGE ROUTINE
01270  REM LINK 106 READS STATE OF KDETECTOR HARDWARE LINE
01280  REM         AND SETS VARIABLE KDET TO VALUE READ.
```

-continued

NCR-DPS BASIC INTERPRETER VERSION 02.01.00 80/12/03

```
01290  REM - - -
```

-continued

NCR-DPS BASIC INTERPRETER VERSION 02.01.00 80/12/03

```
02000  TX(J) = 0
02010  D = 0
02020  RETURN
02030  REM END OF MAIN PROGRAM ------------------------
02040  REM
02050  REM
02060  REM ----------------------------------------------
02070  REM INTERRUPT SERVICE ROUTINE
02080  REM THIS ROUTINE IS ENTERED WHEN A STATION DE-
           PRESSES AN
02090  REM OPEN OR CLOSE SWITCH.
02100  REM ROUTINE RETURNS STATION NUMBER IN J1 (J1 = 1,2 . . . N)
02110  REM AND THE SWITCH TYPE (OPEN OR CLOSE) IN OCF.
           (OCF = 0 OR 1).
02120  REM ----------------------------------------------
02130  REM
02140  REM ----------------------------------------------
02150  REM     LINK TO MACHINE LANGUAGE ROUTINE
02152  REM LINK 109 SELECTS PERIPHERAL INTERFACE UNIT
02154  REM                 AND READS BUS INTO VARIABLES OCF AND
02156  REM                 J1.
02160  REM ----------------------------------------------
02165  LINK 109
02170  D = D + 5
02180  IF OCF = 0 GOTO 2340
02190  REM STATION J1 ACTIVATES OPEN SWITCH ----------------
02200  REM FLAG THIS CONDITION BY: DAT(J) = 2
02210  D = D + 2
02220  IF PTAT(J1) > 0 GOTO 2260
02230  DAT(J1) = 2
02240  D = D + 1
02250  RETURN
02260  PTAT(J1) = PTAT(J1) - 1
02270  D = D + 1
02280  GOTO 2230
02290  RETURN
02300  REM
02310  REM TELLER STATION J1 CLOSES ------------------------
02320  REM FLAG THIS CONDITION BY: DAT(J) = 3
02330  REM
02340  REM
02350  REM REMOVE STATION J1, IF PRESENT, FROM TABLE NATT.
02370  L = 0
02380  FOR I = 1 TO P - 1
02390  IF NATT(I) = J1 THEN L = I
02400  D = D + 2
02410  NEXT I
02420  IF L = 0 GOTO 2510
02430  REM REMOVE STATION J1 FROM NATT(I)
02440  FOR I = L TO P - 1
02450  NATT(L) = NATT(L + 1)
02460  D = D + 2
02470  NEXT I
02480  P = P - 1
02490  NATT(P) = 0
02500  D = D + 2
02510  DAT(J1) = 3
02520  CDT(J1) = DPDT(J1)
02530  D = D + 2
02540  RETURN
02550  REM
02560  REM ----- DEFINE DATA FOR TABLES TLT AND DPDT
02570  DATA 2200,1950,1950,2200
02580  DATA 0,0,1,1
02590  REM ----------------------------------------------
02600  END
```

While the forms of the invention shown and described herein are admirably adapted to fulfill the objects primarily stated, it is to be understood that it is not intended to confine the invention to the forms or embodiments disclosed herein, for it is susceptible of embodiment in various other forms within the scope of the appended claims.

We claim:

1. In a customer queue control system for an establishment having a plurality of stations and utilizing a main queue and a plurality of local queues, each of which local queues may contain more than one customer, the improvement comprising detection means for detecting conditions at each station, timing means for providing a timed period unique for each station, means responsive to said detection means and said timing means for determining which local queue will probably have the shortest wait, and means for generating a voice message to direct a customer at the head of the main queue to a selected local queue.

2. A customer queue control system for an establishment having a plurality of customer service stations and utilizing a main queue and a plurality of local queues, one for each customer service station, comprising:

first means to detect the presence of a customer at the head of the main queue;

second means at each customer service station to signify whether each station is in an open or closed status;

counting means to maintain a count of the numbers of customers in each local queue;

timing means to provide a timed period unique for each customer service station; and customer direction means controlled by the first means, the second means, the counting means and the timing means to direct a customer at the head of the main queue to a local queue associated with one of the customer service stations in accordance with a determination as to which local queue is expected to provide the shortest waiting time for said customer.

3. The customer queue control system of claim 2 in which said first means includes a switch operatively associated with a surface upon which a customer at the head of the main queue stands, to inform the system as to whether or not any customer is in the main queue.

4. The customer queue control system of claim 2, in which said customer direction means includes next available station storage means for storing indicia for identifying the various customer service stations in order corresponding to the order in which the corresponding local queues are to be selected.

5. The customer queue control system of claim 4, also including means for counting down the timing means for the customer service stations, and means for causing the identifying indicia for a station to be entered in the last position of the next available station storage means when the timing means for that station has counted down to zero.

6. The customer queue control system of claim 2, in which said second means includes a first key and a second key at each station which may be operated by personnel at said station to designate whether said station is closed or is open for business.

7. The customer queue control system of claim 6, in which said second means also includes detector means connected to all of said first keys and second keys and capable of informing said customer direction means as to which stations are open for business, and which are not.

8. The customer queue control system of claim 2, also comprising:

storage means for the storage of message segments which may be selected to constitute the content of a message;

directional means for providing data relating to the direction of movement from the main queue to the selected local queue;

identification means for providing data relating to the identity of the teller station associated with the selected local queue;

message data generation means for selecting messages segments from said storage means in accordance with information provided by said directional means and said identification means, to compose a message directing the customer at the head of the main queue to the selected local queue; and message delivery means to provide a message in accordance with the message composed by the message data generation means.

9. The customer queue control system of claim 8, in which the message delivery means includes a speaker, and the message is a voice message.

10. A customer queue control system for an establishment having a plurality of customer service stations, and utilizing a main queue, comprising:

customer direction means to direct a customer at the head of the main queue to one of the customer service stations in accordance with a determination as to which station is expected to provide the shortest waiting time for said customer;

storage means for the storage of message segments which may be selected to constitute the content of a message;

directional means for providing data relating to the direction of movement from the main queue to the selected customer service station;

identification means for providing data relating to the identity of the teller station associated with the selected customer service station; and message data generation means for selecting message segments from said storage means in accordance with information provided by said directional means and said identification means, to compose a message directing the customer at the head of the main queue to the selected customer service station; and message delivery means including a speaker to provide a vocal message in accordance with the message composed by the message data generation means.

11. A customer queue control system for an establishment having a plurality of customer service stations and utilizing a main queue and a plurality of local queues, each local queue being associated with a customer service station, comprising:

a main processor for controlling system operations, main processor memory means for storing information relating to customer availability for each station and the amount of time allocated for servicing a customer at a given station;

first address and data buses coupled to said main processor and to said main processor memory means for transmitting information relating to service station activity to the main processor, and for enabling communication between said main processor, said main processor memory, and other elements of the system;

a speech processor capable of receiving information from the main processor and for controlling the generation of voice messages to customers;

speech processor memory means for storing information relating to customer-directing voice messages;

second address and data buses coupled to said speech processor and said speech processor memory means for transmitting message information from said main processor to said speech processor, and for enabling communication between the speech processor and the speech processor memory means;

buffer means controlled by said main processor for coupling said first and second address and data buses for enabling communication between said main processor and said speech processor;

signal means at each service station to enable the operator of that station to signify the status of that station;

detection and encoding means coupled to said signal means and to said main processor for receiving status information from all stations and for transferring said information to said main processor;

presence indicator means coupled to said main processor for indicating the presence of a customer at the head of the main queue; and speech synthesizer means coupled to the speech processor for receiving message data from the speech processor memory means via the speech processor and for converting said data to an audible message for directing a customer at the head of the main queue to proceed to a selected local queue.

12. A method for customer queue control in an establishment having multiple customer service stations, including the following steps:

(a) providing a main customer queue;

(b) providing a plurality of local customer queues, each associated with a customer service station;

(c) detecting whether each station is in an open or closed status;

(d) detecting whether a customer is present at the head of the main customer queue;

(e) establishing a delay period for each station related to the median customer service time at that station;

(f) utilizing the information provided by steps (c), (d) and (e) to determine which local queue is likely to provide the minimum customer waiting period; and (g) directing the customer at the head of the main queue to the selected local queue.

13. The method of claim 12, in which step (g) is carried out by means of a voice message.

14. The method of claim 12 in which step (g) includes the following steps:

(1) determining the identifying number of the selected station;

(2) determining the direction of the local queue associated with the selected station with respect to the head of the main queue;

(3) composing a customer direction message which includes the station number and the direction in which the customer should proceed; and (4) transmitting the composed message to the customer.

15. The method of claim 14 in which the transmission of the composed message is in vocal form.

16. A method for customer queue control in an establishment having multiple customer service stations, including the following steps:

(a) providing a main customer queue;

(b) providing a plurality of local customer queues, each containing a maximum of two customers and associated with a customer service station;

(c) detecting whether each station is in an open or closed status;

(d) maintaining a count of the number of customers in each local queue;

(e) detecting whether a customer is present at the head of the main customer queue;

(f) establishing a delay period for each station related to the median customer service time at that station (g) utilizing the information provided by steps (c), (d), (e) and (f) to immediately add a customer to an empty local queue and to determine which local queue having one customer therein is likely to provide the least customer waiting period; and (h) directing the customer at the head of the main queue to that local queue which has been selected in step (g).

17. The method of claim 16, in which step (h) is carried out by means of a voice message.

* * * * *

UNITED STATES PATENT AND TRADEMARK OFFICE

CERTIFICATE OF CORRECTION

PATENT NO. : 4,398,257

DATED : August 9, 1983

INVENTOR(S) : Bruno J. Paganini et al.

It is certified that error appears in the above—identified patent and that said Letters Patent is hereby corrected as shown below:

Column 25, line 63 delete "messages" and substitute --message--.

Signed and Sealed this

*Tenth* Day of *July 1984*

[SEAL]

*Attest:*

GERALD J. MOSSINGHOFF

*Attesting Officer*

*Commissioner of Patents and Trademarks*